US011641941B2

(12) United States Patent
Cattaneo

(10) Patent No.: US 11,641,941 B2
(45) Date of Patent: May 9, 2023

(54) CONCEALED TEAR-RESISTANT HANGING-BRACKET GROUP WITH PRECISE DEPTH ADJUSTMENT

(71) Applicant: Leonardo S.r.l., Figino Serenza (IT)

(72) Inventor: Carlo Cattaneo, Figino Serenza (IT)

( * ) Notice: Subject to any disclaimer, the term of this patent is extended or adjusted under 35 U.S.C. 154(b) by 165 days.

(21) Appl. No.: 16/648,228

(22) PCT Filed: Sep. 19, 2018

(86) PCT No.: PCT/IB2018/057211
§ 371 (c)(1),
(2) Date: Mar. 18, 2020

(87) PCT Pub. No.: WO2019/069167
PCT Pub. Date: Apr. 11, 2019

(65) Prior Publication Data

US 2020/0260869 A1 Aug. 20, 2020

(30) Foreign Application Priority Data

Oct. 3, 2017 (IT) ..... 102017000110599

(51) Int. Cl.
*A47B 95/00* (2006.01)

(52) U.S. Cl.
CPC ..... *A47B 95/008* (2013.01)

(58) Field of Classification Search
CPC ..... A47B 95/00; A47B 95/002; A47B 95/008; A47B 2095/004; A47B 2095/006; A47B 2230/0014; A47B 96/067; A47B 96/07
See application file for complete search history.

(56) References Cited

U.S. PATENT DOCUMENTS

| | | | | |
|---|---|---|---|---|
| 5,090,652 | A * | 2/1992 | Cattaneo | A47B 95/008 24/590.1 |
| 10,010,176 | B2 * | 7/2018 | Cattaneo | A47B 95/008 |
| 10,750,864 | B2 * | 8/2020 | Cattaneo | F16B 45/00 |
| 10,881,206 | B2 * | 1/2021 | Cattaneo | A47B 95/008 |

(Continued)

FOREIGN PATENT DOCUMENTS

| | | | | |
|---|---|---|---|---|
| DE | 3839931 | A1 * | 5/1990 | A47B 95/008 |
| DE | 29507071 | U1 * | 8/1995 | A47B 95/008 |
| DE | 20103728 | U1 * | 5/2001 | A47B 95/008 |

(Continued)

*Primary Examiner* — Jonathan Liu
*Assistant Examiner* — Guang H Guan
(74) *Attorney, Agent, or Firm* — Themis Law

(57) ABSTRACT

A concealed tear-resistant hanging-bracket group with precise depth adjustment for assembling a wall cupboard to a wall includes a plate and a hooking element. The plate has a plurality of fixing pins for engagement to a shoulder of the wall cupboard, and the hooking element couples the hanging-bracket group to a supporting element fixed to the wall. The hanging-bracket group is adjustable in depth and height by action of horizontal and vertical movement members. The horizontal movement member includes a threaded hole formed in a protrusion in the plate and a grub screw received in the threaded hole, a rotation of the grub screw causing a depth adjustment A guiding member for a screwdriver is coupled to the plate and includes a guiding element positioned in a pass-through opening of the plate, below and adjacent to the protrusion.

12 Claims, 9 Drawing Sheets

(56) References Cited

U.S. PATENT DOCUMENTS

| | | | | |
|---|---|---|---|---|
| 2017/0143120 | A1* | 5/2017 | Cattaneo | A47B 95/008 |
| 2020/0260869 | A1* | 8/2020 | Cattaneo | A47B 96/07 |

FOREIGN PATENT DOCUMENTS

| | | | | |
|---|---|---|---|---|
| DE | 202004012107 | U1 * | 11/2004 | A47B 95/008 |
| DE | 202007006527 | U1 * | 10/2008 | A47B 95/008 |
| DE | 102016101624 | | 1/2017 | |
| EP | 1008316 | A1 * | 6/2000 | A47B 95/008 |
| EP | 1362531 | A1 * | 11/2003 | A47B 95/008 |
| EP | 2946692 | | 11/2015 | |
| WO | WO-2004032681 | A1 * | 4/2004 | A47B 95/008 |
| WO | WO-2009077828 | A1 * | 6/2009 | A47B 95/008 |

* cited by examiner

CONCEALED TEAR-RESISTANT HANGING-BRACKET GROUP WITH PRECISE DEPTH ADJUSTMENT

The present invention relates to a concealed tear-resistant hanging-bracket group with precise depth adjustment.

Various solutions have been developed in the field of concealed hanging brackets suitable for being assembled in an external rear position of a wall cupboard.

Some solutions provide a well-concealed hanging bracket, once coupled with a shoulder beneath the top and constrained to the wall. These hanging brackets can also be equipped with anti-disengagement means against an accidental detachment of the wall cupboard in the case of collisions.

These hanging brackets normally consist of a single plate element provided with protrusions or side pins coupled, during assembly, with a side shoulder of the piece of furniture. Furthermore, said hanging brackets have a movable hooking element articulated to the plate for fixing to the wall. Finally, as already mentioned, an anti-disengagement device is provided to prevent an accidental detachment of the wall cupboard from the wall.

Solutions have also been developed which, instead of providing access to adjustments in depth and height from holes formed in the rear part of the cupboard, also allow access from the front part, or even from both sides, depending on the specific requirement.

In some cases, the hanging brackets also provide separate elements produced from a mould, which are made integral with the base plate, these elements, however, are not suitable for providing threaded holes as they are subject to possible tear with poor thread resistance.

Holes formed directly in the sheet of the base plate, moreover, cannot guarantee a correct positioning of the same, even more so if they are guiding holes, where great precision is required.

And, as is known, the sheet may, in some cases, not be sufficiently rigid when exposed to stress by both blocking and adjustment threaded elements.

The general objective of the present invention is to solve all of the above-mentioned drawbacks of the known art, in an extremely simple, economical end particularly functional manner.

A further objective of the present invention is to provide a concealed hanging-bracket group provided or not provided with an anti-disengagement device which guarantees a firm assembly, with the smallest number of component parts with possible tear resistance and with secure connection in the view of the most varied kinds of stress.

Yet another objective of the present invention is to provide a concealed hanging-bracket group with as few components as possible even with the presence of security of the group.

A further objective of the present invention is to provide a concealed hanging-bracket group having sufficient rigidity when subjected to stress, precision in the guiding and positioning of the elements and tools for the assembly and resistance to various kinds of stress.

In view of the above objectives, according to the present invention, a concealed tear-resistant hanging-bracket group has been conceived, with a precise adjustment in depth, having the characteristics specified in the enclosed claim 1 and subordinate claims.

The structural and functional characteristics of the present invention and its advantages with respect to the known art will be even more evident from the following description referring to the attached drawings which show a concealed and adjustable hanging bracket for the wall assembly of a wall cupboard produced according to the present invention.

Figure 1:
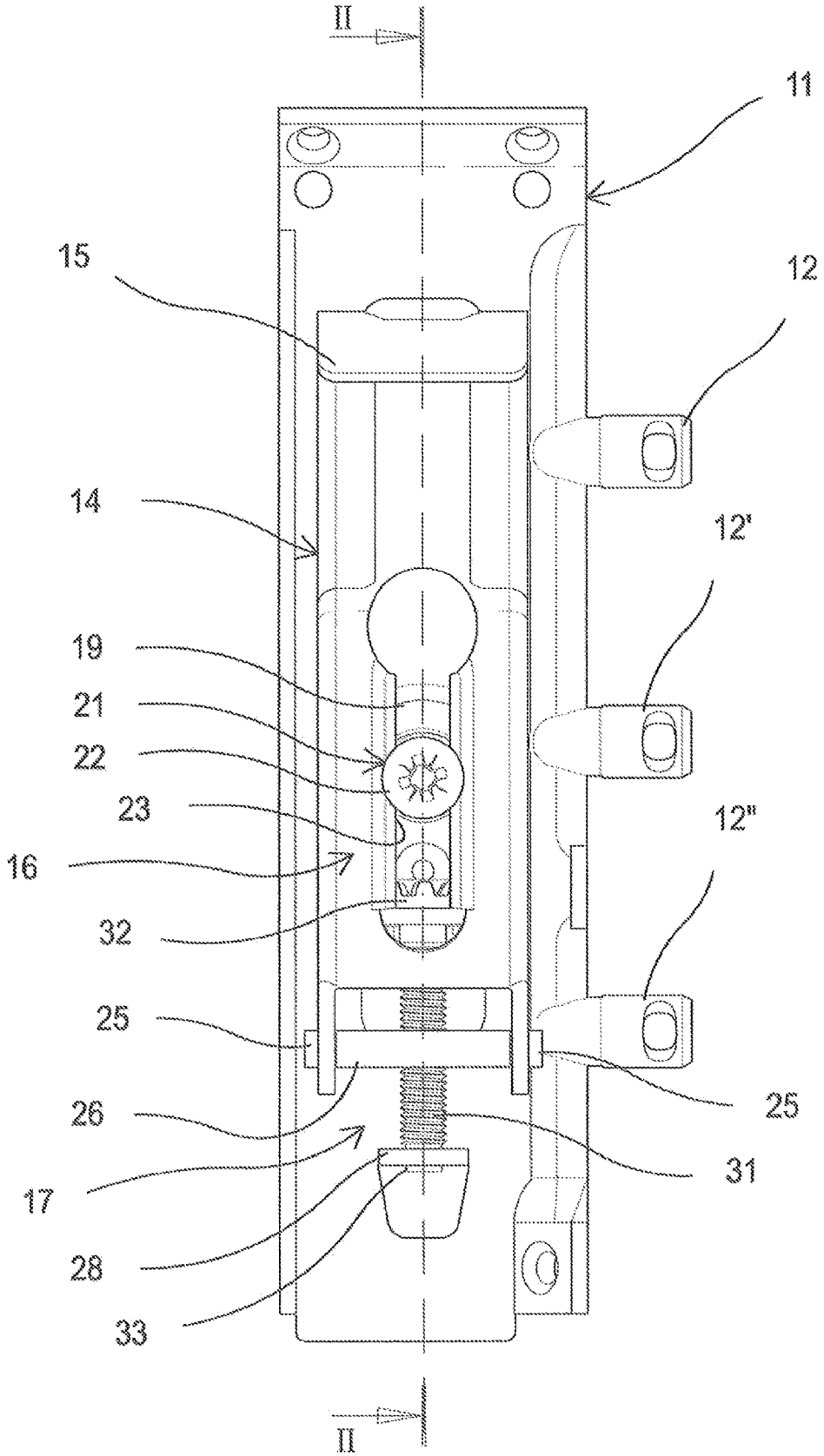
FIG. 1 shows a front view of the concealed hanging-bracket group for the wall assembly of a wall cupboard in a first embodiment according to the present invention.
Figure 2:
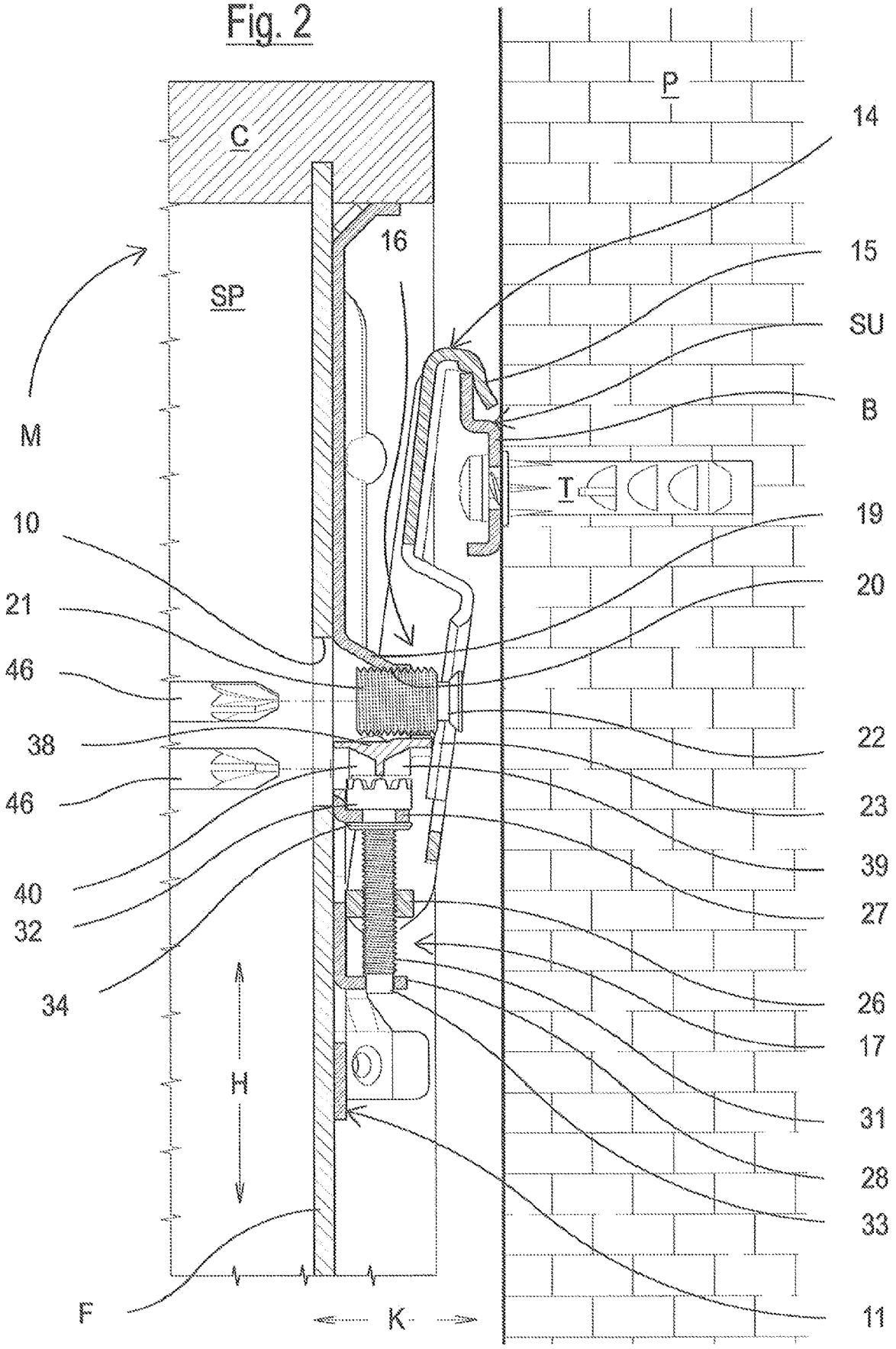
FIG. 2 is a sectional view of the concealed hanging-bracket group according to the line II-II of FIG. 1 with the addition of furniture and wall.
Figure 3:
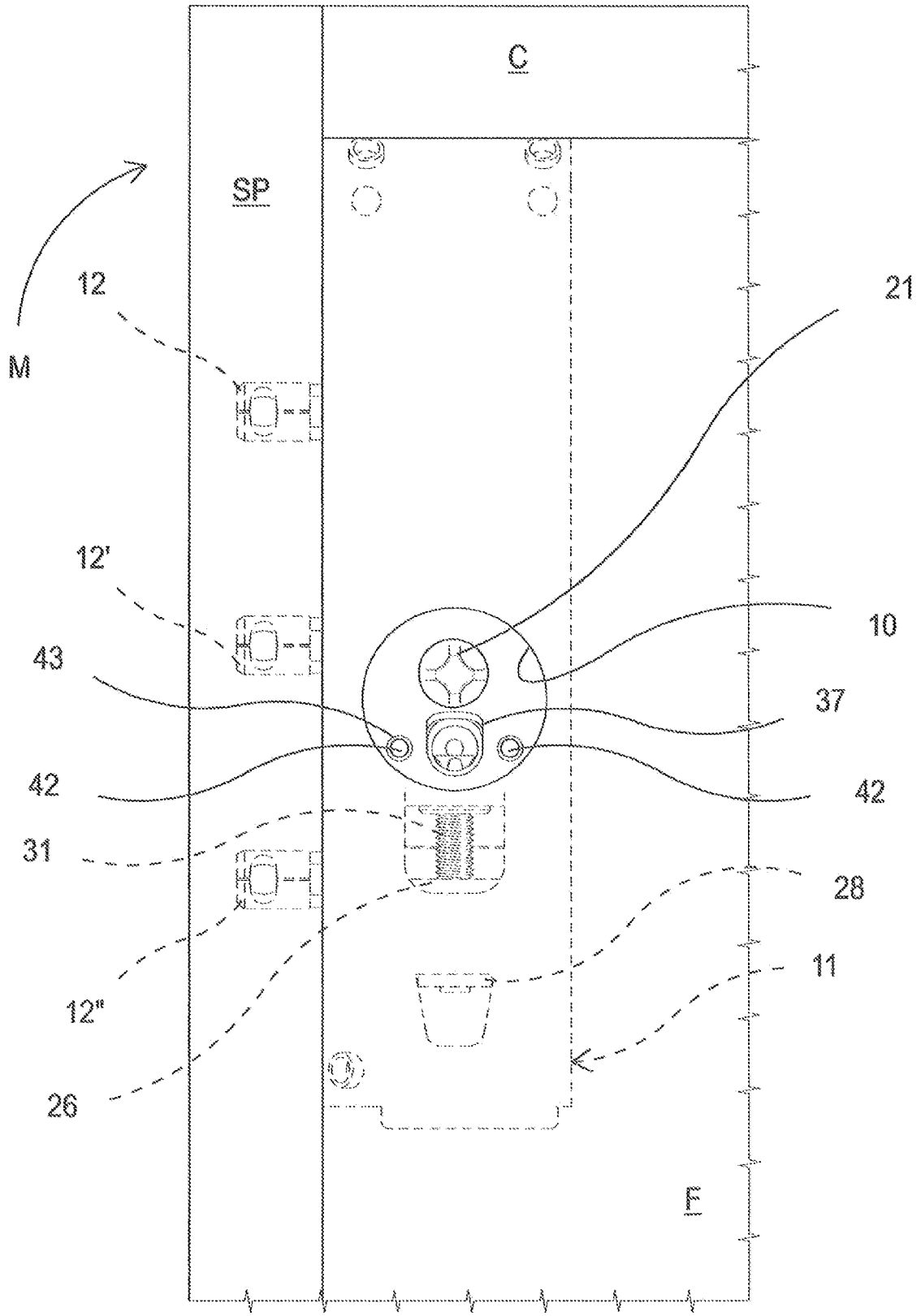
FIG. 3 is a rear view of the concealed hanging-bracket group shown in FIGS. 1 and 2.
Figure 4:
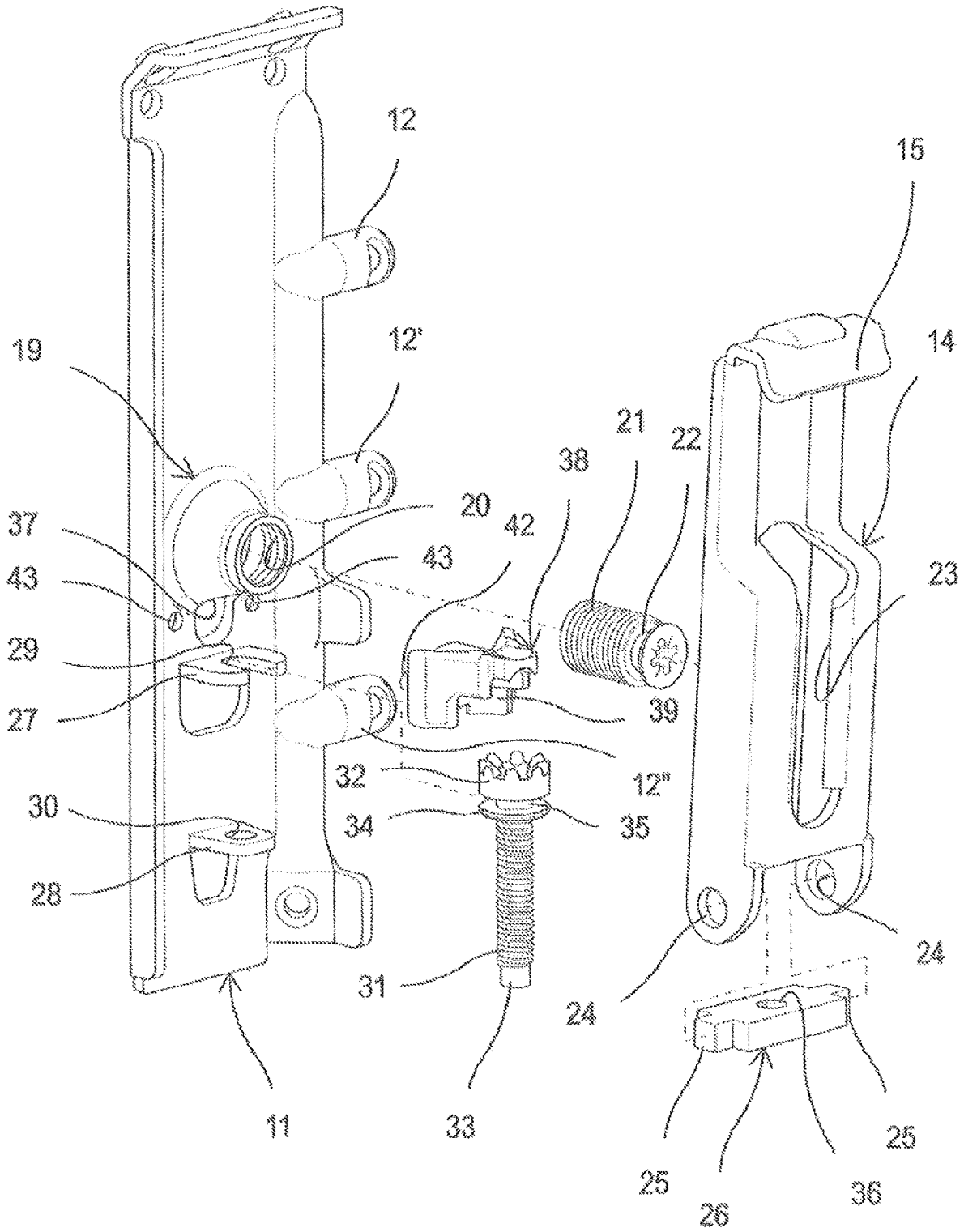
FIG. 4 is an exploded perspective view of the hanging-bracket of FIGS. 1, 2 and 3.

With reference to the figures, these show a concealed tear-resistant hanging-bracket group with precise depth adjustment with or without anti-disengagement according to the invention.

Said hanging-bracket group is of the adjustable type and is suitable for being assembled at the rear, in a concealed position, on a wall cupboard M provided with a shoulder SP and top C.

The hanging-bracket group comprises a plate element 11 provided with a plurality of fixing pins 12, 12', 12", which extend outwards from one side of the plate element 11 (and/or also from the other side), and a hooking element 14. The hooking element 14 is coupled at the front with the plate element 11 to constrain the actual hanging-bracket with a supporting element SU fixed to a wall P. Again in a known way, the plurality of fixing pins 12, 12', 12", is coupled in holes formed on a shoulder SP of the wall cupboard M. Furthermore, the above-mentioned supporting element fixed to the wall P on which the hanging-bracket is constrained, can, for example, be a simple shaped bar B held on the wall P by dowels T.

It should also be pointed out that, also in the hanging bracket object of the invention, the hooking element 14 can be adjusted in depth according to the arrow K and height according to the arrow H with respect to the relative plate element 11 and is provided with an upper hook-shaped portion 15 for coupling with the above-mentioned bar B fixed to the wall P by the dowels T.

Horizontal and vertical movement means 16, 17, such as, for example, a known screw-nut screw mechanism, possibly provided with angular transmissions and an adjustment grub screw, and anti-disengagement means 18, if provided, are provided in order to effect said adjustment in depth and in height. Said movement means and anti-disengagement means are easily accessible for a user during both the assembly phases and with the hanging bracket assembled, from holes formed in a lining F at the rear of the furniture.

In this case, a single hole 10 is provided for the passage of tips of a screwdriver 46, as the maneuvering points of the adjustments in depth and in height are very close.

The plate 11 is formed from a single moulded sheet wherein a fixing arrangement is provided for the movement means 16 and 17 and horizontal and vertical adjustment, and for the anti-disengagement means 18, when present.

The plate 11 has, in fact, through a deep-drawing operation, a deep-drawn protrusion 19, provided centrally with an internally threaded hole 20 suitable for receiving an adjustment screw 21, or grub screw, provided with a recessed head 22. The recessed head 22 is inserted in a groove 23 provided in a box-shaped body of the hooking element 14.

It should be pointed out that the hooking element 14, at an opposite end with respect to the hook-shaped portion 15, has slots 24 suitable for receiving pivot ends 25 of a platelet 26 which make it integral and articulated with respect to the plate 11.

Supports for the movement means 16 and 17 of the horizontal and vertical adjustments are also provided and formed in the plate 11.

In this respect, in the example, these supports in the plate 11 are represented by two appendices 27 and 28, obtained by half-blanking of the plate 11, vertically aligned beneath the deep-drawn protrusion 19. The two appendices 27 and 28 are square-folded with respect to the surface of the plate 11.

The first appendix 27 has a groove 29, rounded and open outwardly. The second appendix 28, on the other hand, has a pass-through hole 30.

A screw 31 is provided at one end with a toothed crown 32 and at the other end with a narrow cylindrical section 33 and is positioned between the two appendices 27 and 28. The screw 31 beneath the toothed crown 32 has a flange or collar 34 protruding outwardly, forming a seat 35 which is engaged in the groove 29, rounded and open outwardly of the first appendix 27. Furthermore, the narrow cylindrical section 33 of the screw 31 is engaged in the pass-through hole 30 of the second appendix 28. The screw 31 is therefore free to rotate when actuated by the toothed crown 32, allowing the adjustment operations.

It should also be pointed out that an intermediate section of the screw 31 is screwed into the threaded pass-through hole 36 of the platelet 26 which carries the hooking element 14 integrally and articulated.

Furthermore, in both examples of the figures shown for the two embodiments, a pass-through opening 37 is formed, beneath the deep-drawn protrusion 19, in the sheet of the plate 11, obtained above the appendix 27, forming part of the supports of the movement means 17 of the vertical adjustment. Said opening 37 is suitable for receiving a guiding element 38 moulded in zamak (or in a plastic material) which forms a guide for the tip of a screwdriver. This guiding element 38, in fact, provides, on opposite sides, two guiding seats 39 and 40 separated by an intermediate septum 41 which acts as a stop for the tip of the screwdriver.

Said guiding element 38 is also provided with a pair of plugs or extensions 42 to be inserted in holes 43 of the plate 11 and to be riveted on the sheet of the plate 11 from the rear as riveting and fixing points of the guiding element 38 to the plate 11.

Figure 7:
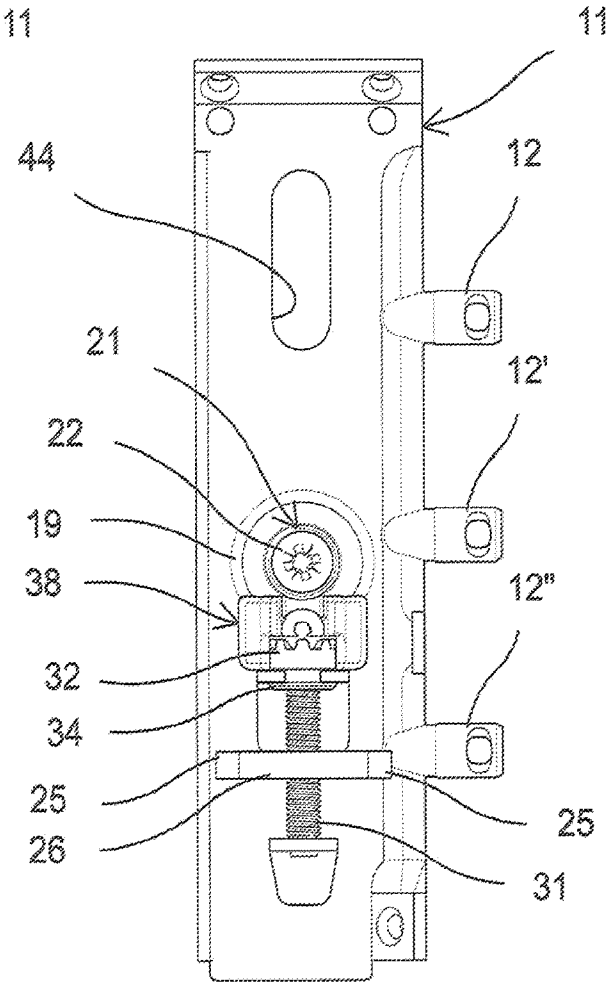
FIGS. 5, 6 and 7 show a succession of views of the plate alone of the group of FIG. 5 to which, in FIGS. 6 and 7, the guiding element and other adjustment means are added, which clarify the reciprocal position of the parts.
Figure 6:
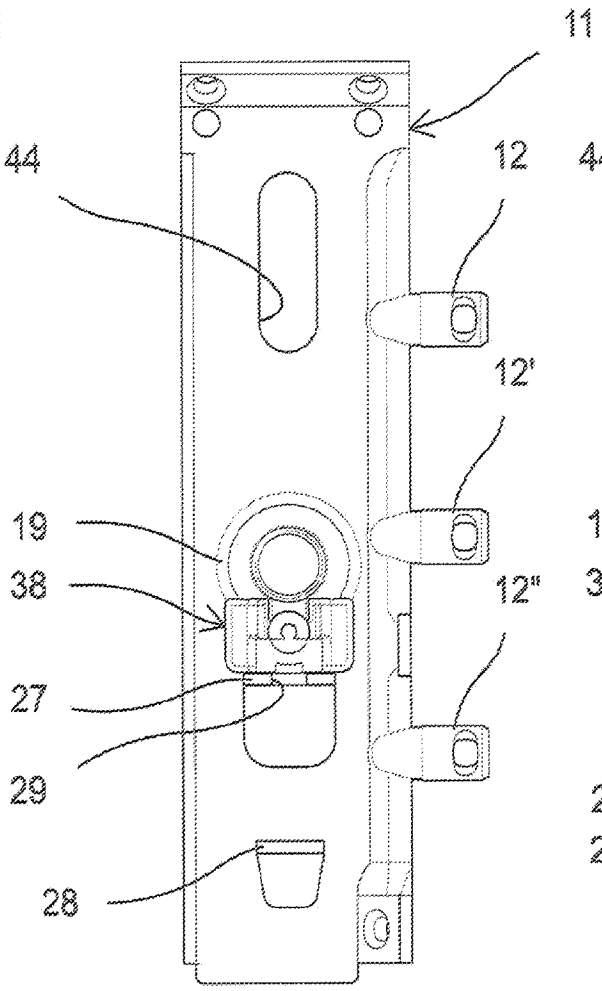
Figure 5:
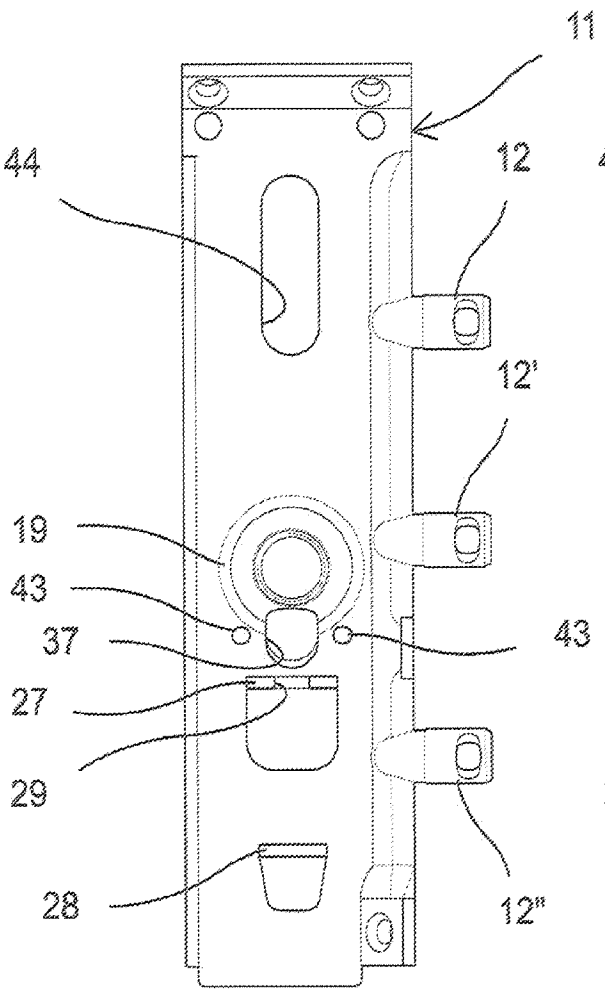
Figure 8:
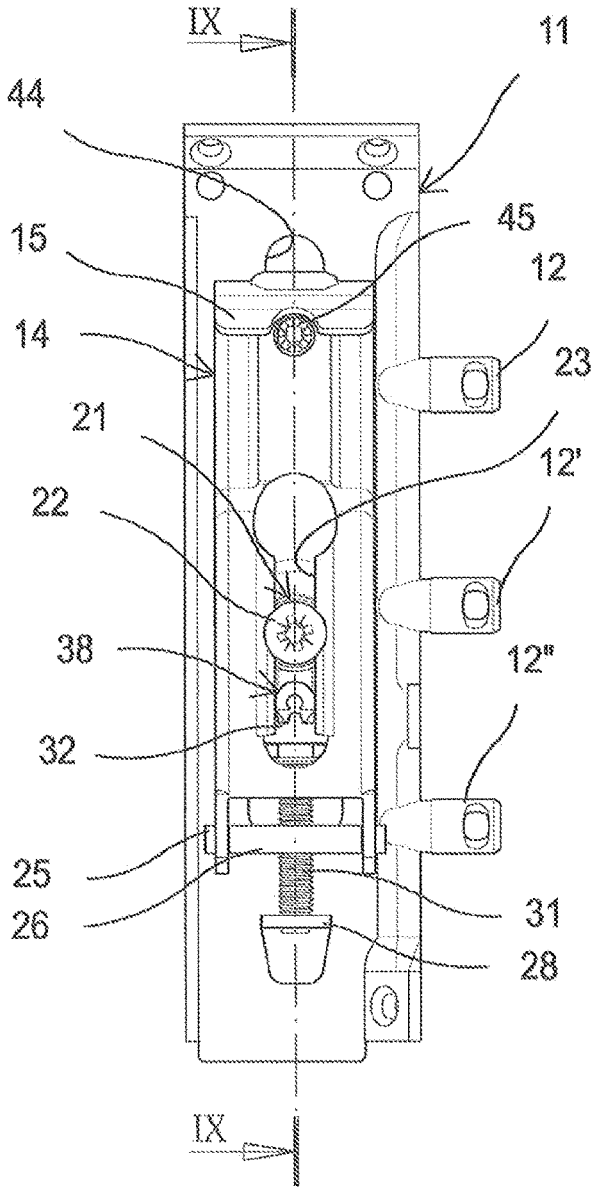
FIG. 8 shows a front view of the concealed hanging-bracket group for the wall assembly of a wall cupboard in a second embodiment with anti-disengagement according to the present invention and FIG. 8*a* shows a section of FIG. 8 in a withdrawn position.
Figure 8A:
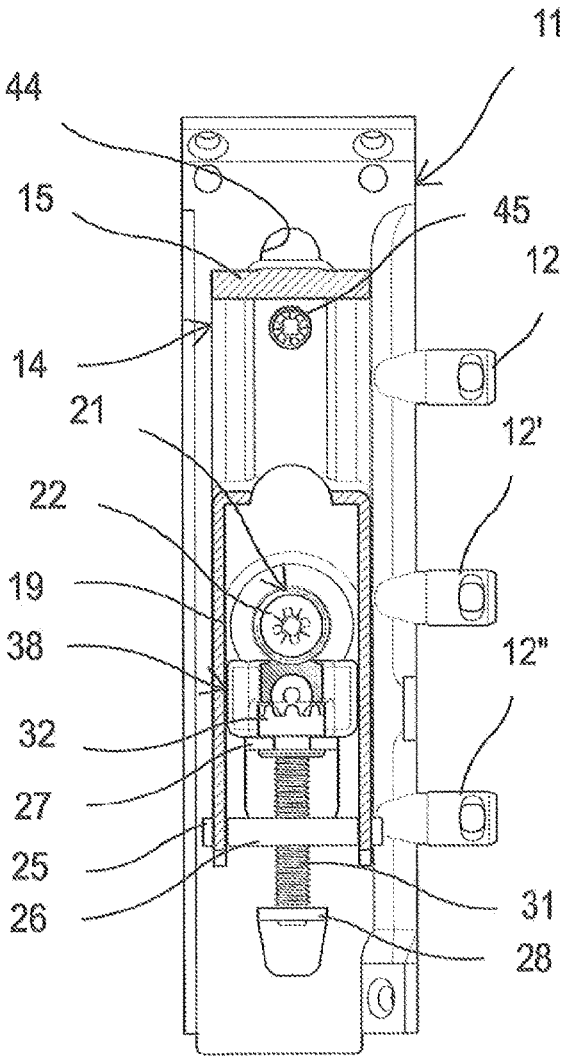
Figure 9:
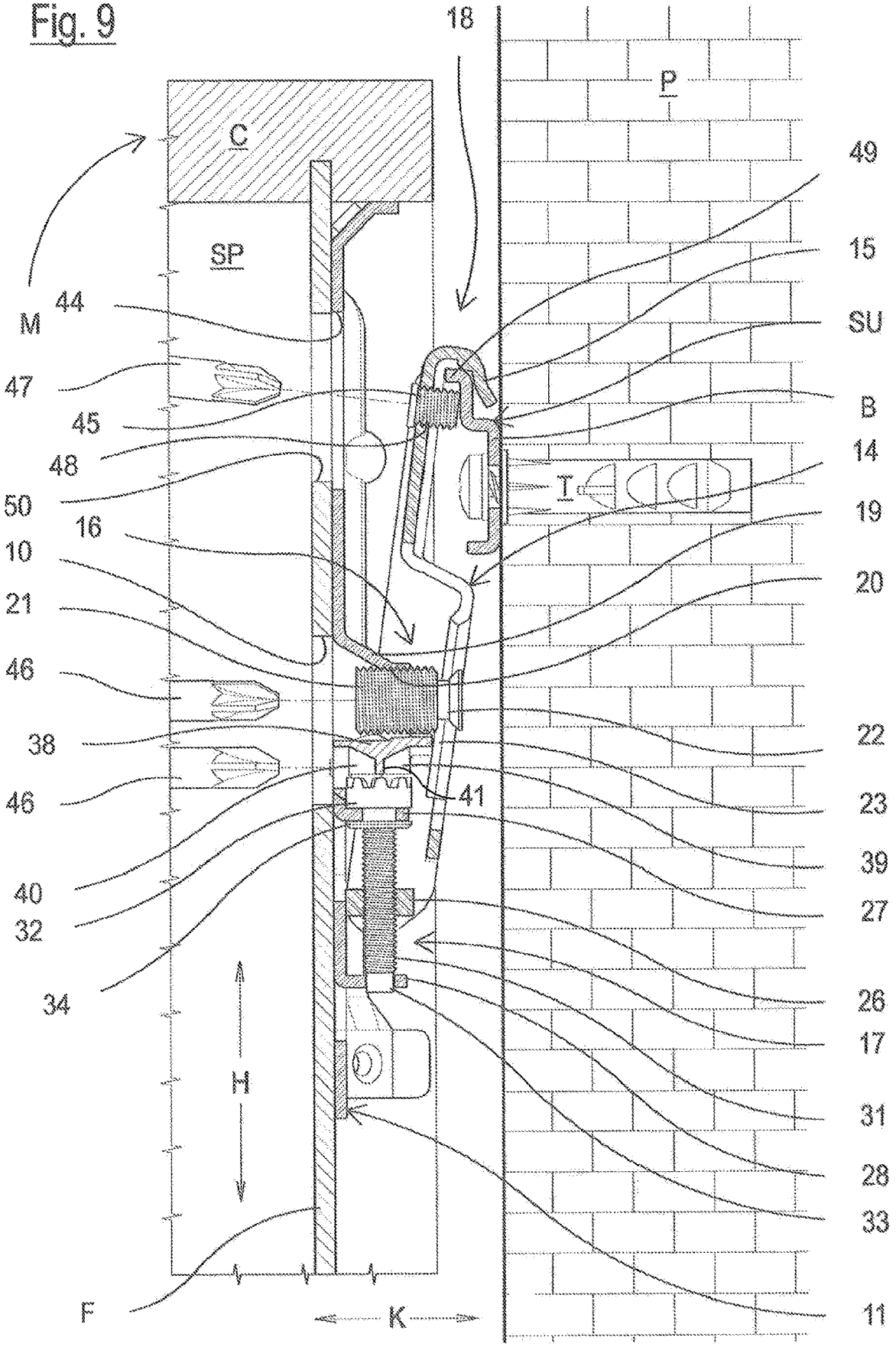
FIG. 9 is a sectional view of the concealed hanging-bracket group according to the line IX-IX of FIG. 8 with the addition of furniture and wall.
Figure 10:
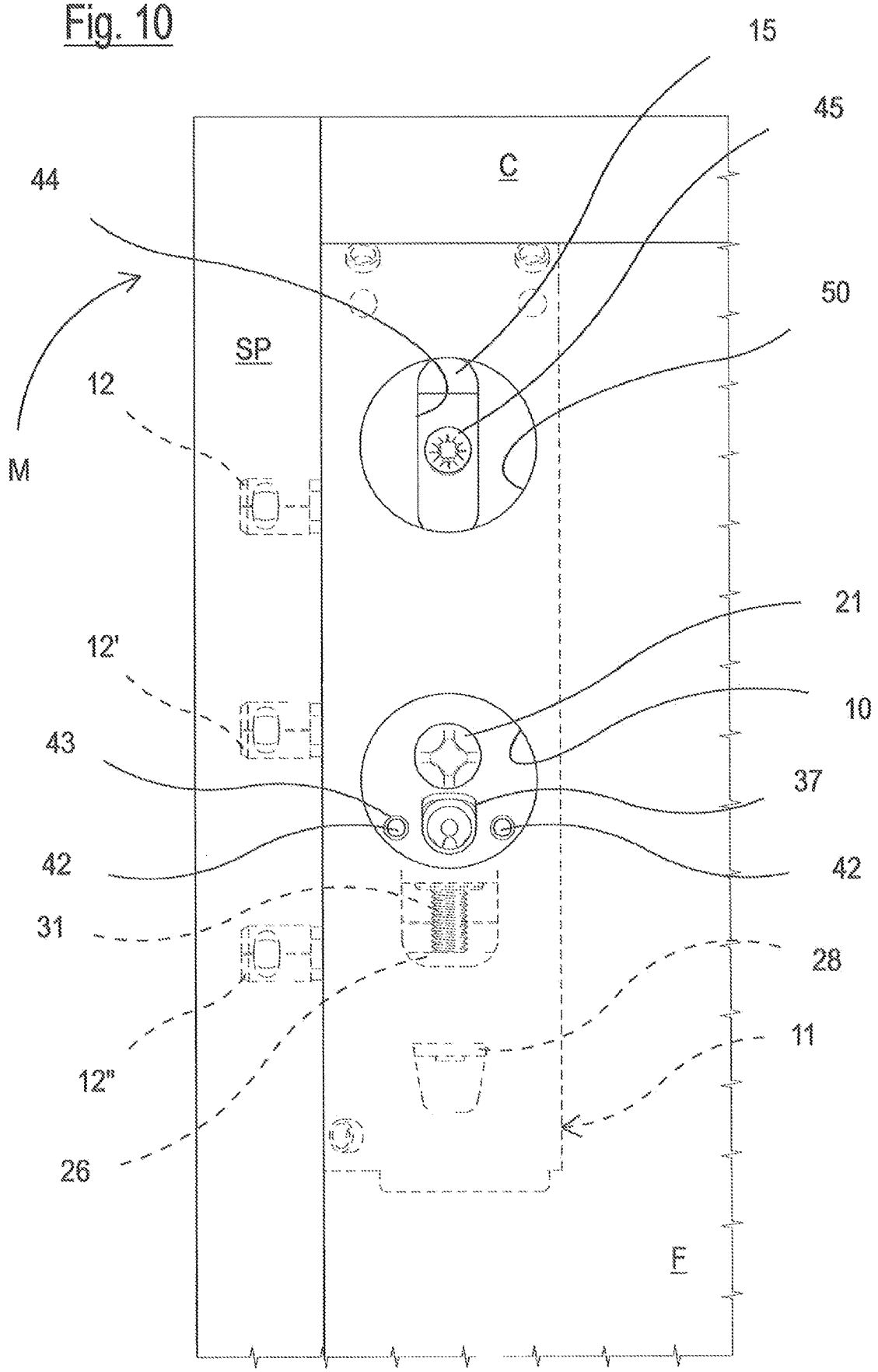
FIG. 10 is a rear view of the concealed hanging-bracket group shown in FIGS. 8 and 9.
Figure 11:
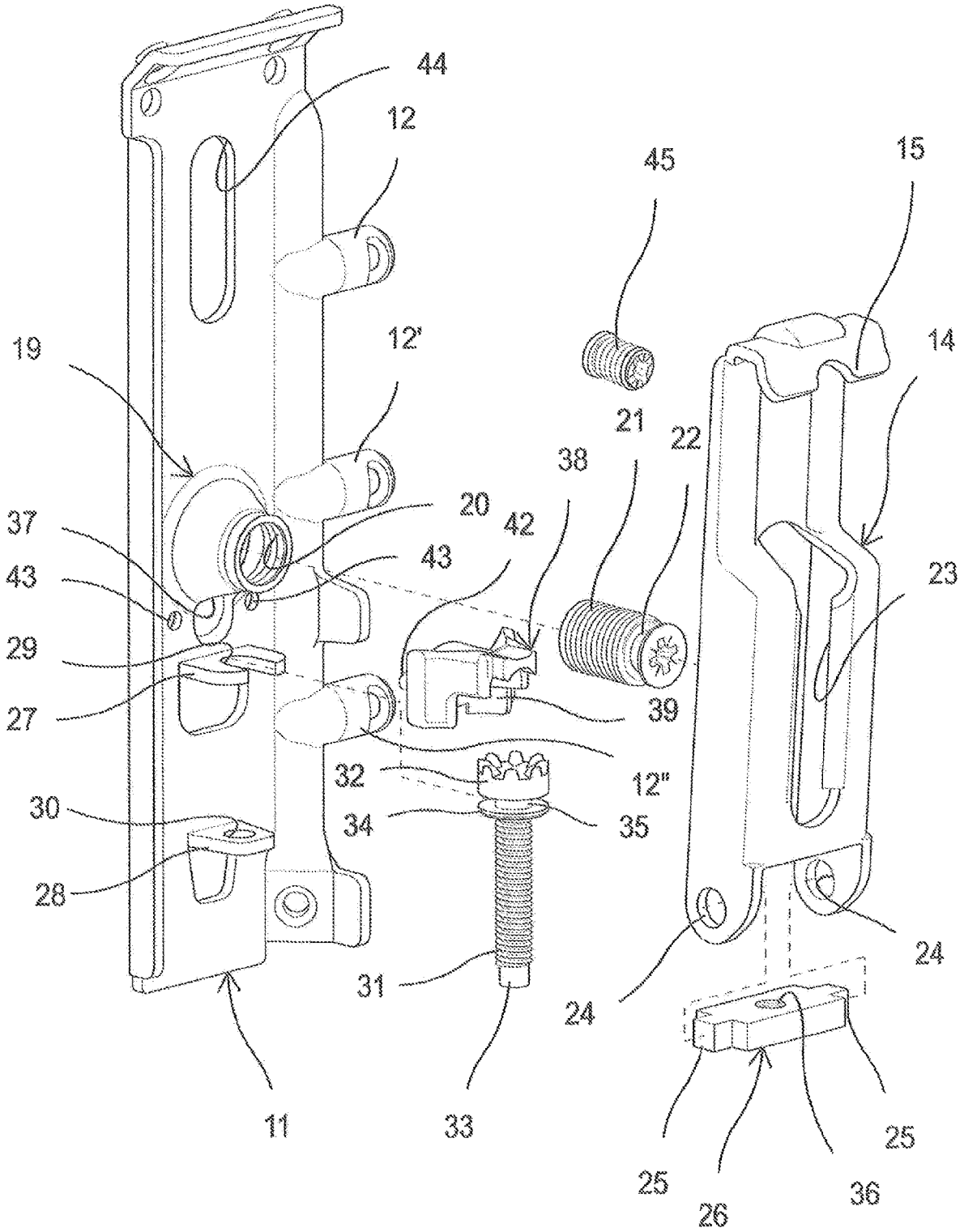
FIG. 11 is an exploded perspective view of the hanging bracket of FIGS. 8, 9 and 10.

This arrangement allows a precise positioning of the guiding element 38 on the plate 11 and at the same time provides a secure guide for the tip of the screwdriver. FIGS. 5 to 7 show in detail and with extreme clarity, the arrangement of the guiding element 38 in the hanging bracket of the present invention.

It can be noted how this guiding element 38 is arranged quite precisely in the space existing below the deep-drawn protrusion 19. At the same time, this guiding element 38 is positioned in the pass-through opening 37 formed in the sheet of the plate 11 immediately above the appendix 27 which form a first part of the supports of the movement means 16 of the horizontal regulation.

This arrangement allows a stable and secure positioning of the guiding element 38.

The positioning by means of pins 42 inserted and riveted in the sheet of the plate 11, causes a stable positioning also in view of possible unforeseen stress.

These elements are provided for in both examples of the concealed tear-resistant hanging-bracket group, with precise depth adjustment according to the present invention.

It should also be pointed out that the concealed hanging-bracket group of FIGS. 1 to 7 is a group that does not provide anti-disengagement means. The concealed hanging-bracket group of FIGS. 8 to 11, on the other hand, is a group which provides anti-disengagement means.

In the two examples of concealed hanging-bracket groups the same reference numbers have been used for the same elements.

Furthermore, it should be pointed out that a slot 44 is formed in the plate 11, from which a tip of a screwdriver 47 passes, which actuates a grub screw 45 that is screwed into a hole 48 of the hooking element 14 and is abutted in an undercut 49 of the above-mentioned bar B which forms an anti-disengagement group 18.

In this way, it is possible to actuate the anti-disengagement means 18, for example by passing from a hole or opening 50 formed in the lining F of the furniture M and from a further opening or slot 44 produced in the plate 11.

In conclusion, the rotation of the screw 21 by means of the tip of the screwdriver inserted either in the rear part of the deep-drawn protrusion 19 or in the head 22 of the screw 21, causes a regulation in depth of the hanging bracket.

A tip of a screwdriver, when inserted in the pass-through opening 37 and in the guiding seat 40 of the guiding element 38 for a rear actuation or alternatively for a front actuation in the guiding seat 40 of the guiding element 38, causes an engagement on the toothed crown 32 of the screw 31.

A rotation of this screw 32 forces the platelet 26, which carries the hooking element 14 integrally and articulated, to move in height, causing an adjustment in height of the hanging bracket according to the arrow H.

Finally, as already specified, a tip of a screwdriver, when inserted to pass into the slot 49 of the plate 11, causes an engagement of the grub screw 45 in an undercut of the bar B on the wall P, forming an anti-disengagement group.

From what is described above with reference to the figures, it is evident that a concealed hanging bracket according to the present invention is particularly useful and advantageous.

The objectives mentioned in the preamble of the description have therefore been achieved.

The concealed and adjustable hanging-bracket group for the wall assembly of a wall cupboard according to the present invention guarantees, in fact, an easy and firm assembly on any type of wall cupboard.

The forms and materials of the concealed and adjustable hanging-bracket for the wall assembly of a wall cupboard according to the present invention can naturally differ from that shown for purely illustrative and non-limiting purposes in the drawings.

The protection scope of the invention is therefore defined by the enclosed claims.

The invention claimed is:

1. A concealed tear-resistant hanging-bracket group for a wall cupboard, the concealed tear-resistant hanging-bracket group comprising:

a hanging bracket comprising:

a plate element provided with a plurality of fixing pins configured to be coupled in holes formed on a shoulder of the wall cupboard, and a hooking element provided with an upper hook-shaped portion and configured to engage the hanging bracket to a supporting element fixed to a wall, wherein the hanging bracket defines a horizontal movement mechanism configured to enable an adjustment in depth of the hanging bracket, wherein the hanging bracket defines a vertical movement mechanism configured to enable an adjustment in height of the hanging bracket, wherein the horizontal movement mechanism comprises:

a deep-drawn protrusion obtained by a deep-drawing in the plate element and provided with a threaded hole, and a first grub screw configured to be received in the threaded hole and engage the hooking element, such that a rotation of the first grub screw is capable of causing the adjustment in depth of the hanging bracket, and wherein the vertical movement mechanism comprises:

a height-adjustment screw provided with a toothed crown, an outwardly protruding flange, and a seat defined between the toothed crown and the outwardly protruding flange, and a guiding element non-rotatably fixed to the plate element and configured to receive a tip of a screwdriver for rotating the height-adjustment screw, such that a rotation of the height-adjustment screw is capable of causing the adjustment in height of the hanging bracket, wherein the guiding element is positioned in a pass-through opening of the plate element, adjacently to the deep-drawn protrusion, and beneath the deep-drawn protrusion.

2. The concealed tear-resistant hanging-bracket group according to claim 1, wherein the pass-through opening of the plate element is formed adjacently to and beneath the deep-drawn protrusion of the plate element.

3. The concealed tear-resistant hanging-bracket group according to claim 1, wherein the guiding element has, on opposite sides, two guiding seats separated by an intermediate septum, which acts as a stop for the tip of the screwdriver.

4. The concealed tear-resistant hanging-bracket group according to claim 1, wherein the guiding element is molded in zamak or a plastic material, and the guiding element is provided with a pair of pins or extensions to be inserted in holes defined in the plate element and to be riveted on a sheet of the plate element.

5. The concealed tear-resistant hanging-bracket group according to claim 1, further comprising anti-disengagement means.

6. The concealed tear-resistant hanging-bracket group according to claim 5, wherein the anti-disengagement means comprise a second grub screw configured to be screwed into a hole of the hooking element and arranged to abut against an undercut of the supporting element fixed to the wall.

7. The concealed tear-resistant hanging-bracket group according to claim 6, wherein a slot is formed in the plate element, the slot being positioned to provide access to the second grub screw.

8. The concealed tear-resistant hanging-bracket group according to claim 1, wherein a portion of the plate element defines two appendices positioned beneath the deep-drawn protrusion, the two appendices being obtained through half-blanking of the plate element, the two appendices being square-folded with respect to a surface of the plate element, the two appendices engaging the height-adjustment screw.

9. The concealed tear-resistant hanging-bracket group according to claim 8, wherein a first one of the two appendices has a groove, rounded and open outwardly and horizontally to receive the seat of the height-adjustment screw, and a second one of the two appendices has a pass-through hole for receiving an end of the height-adjustment screw, the height-adjustment screw being free to rotate.

10. The concealed tear-resistant hanging-bracket group according to claim 9, wherein the seat of the height-adjustment screw is engaged in the groove of the first one of the two appendices.

11. The concealed tear-resistant hanging-bracket group according to claim 8, wherein an intermediate section of the height-adjustment screw is screwed into a threaded pass-through hole of a platelet, the platelet being positioned integrally with the hooking element and configured to be articulated with respect to the hooking element.

12. The concealed tear-resistant hanging-bracket group according to claim 11, wherein the platelet is engaged to a lower portion of the hooking element, the lower portion being opposite to the upper hook-shaped portion.

* * * * *